US005983922A

United States Patent [19]

Laing et al.

[11] Patent Number: 5,983,922

[45] Date of Patent: Nov. 16, 1999

[54] INSTANTANEOUS HOT-WATER DELIVERY SYSTEM

[76] Inventors: Karsten A. Laing; Nikolas J. Laing, both of 1253 La Jolla Rancho Rd., La Jolla, Calif. 92037

[21] Appl. No.: 09/020,349

[22] Filed: Feb. 9, 1998

Related U.S. Application Data

[63] Continuation-in-part of application No. 08/669,147, Jun. 24, 1996.

[30] Foreign Application Priority Data

Jun. 26, 1995 [DE] Germany ..... 195 23 045
Aug. 1, 1997 [DE] Germany ..... 197 33 201

[51] Int. Cl.[6] ..... F04B 49/00

[52] U.S. Cl. ..... 137/338; 137/337; 137/340; 417/435; 417/413.1

[58] Field of Search ..... 137/236, 237, 137/565.3, 565.31, 338, 340, 337; 417/435, 413.1; 126/362

[56] References Cited

U.S. PATENT DOCUMENTS

| | | | |
|---|---|---|---|
| 1,831,961 | 11/1931 | Lemp | 137/338 |
| 2,327,910 | 8/1943 | Levine | 137/338 |
| 2,444,586 | 7/1948 | Wuensch | 417/435 |
| 2,446,498 | 8/1948 | Underwood | 137/338 |
| 2,777,663 | 1/1957 | Axlander | 137/337 |
| 3,294,031 | 12/1966 | Latawic | 417/436 |
| 4,372,918 | 2/1983 | Woods et al. | 422/129 |
| 4,936,289 | 6/1990 | Peterson | 126/362 |
| 5,009,572 | 4/1991 | Imhoff et al. | 417/32 |
| 5,143,049 | 9/1992 | Laing et al. | 126/362 |
| 5,277,219 | 1/1994 | Lund | 137/337 |

*Primary Examiner*—A. Michael Chambers
*Attorney, Agent, or Firm*—Henri J. A. Charmasson; John D. Buchaca

[57] ABSTRACT

In a hot and cold water distribution system wherein the hot water is delivered from a water heater to a distant hot water tap adjacent to a cold water tap, a hot water recirculation pump assembly purges the hot water line of any cooled-down water in order to assure instant hot water delivery when the hot water tap is opened. The volume of water drawn from the hot water line is, in a first embodiment of the invention, cooled down through a radiator before being recirculated through the cold water line faucet. In a second embodiment, the volume of cooled down water is flushed back through the hot water line by admission of an equal volume of cold water in that line. That volume of cold water is immediately pumped back into the cold water line, and automatically replaced by hot water drawn from the water heater. Each embodiments prevent any drawing of lukewarm water from the cold water tap. The pump assembly includes a pressure-sensitive check-valve in the pressure region of each pump.

13 Claims, 4 Drawing Sheets

INSTANTANEOUS HOT-WATER DELIVERY SYSTEM

PRIOR APPLICATION

This is a continuation-in-part of application 08/669,147, filed Jun. 24, 1996 pending.

FIELD OF THE INVENTION

The invention relates to a hot water distribution systems, and more specifically to recirculation pumps for assuring instantaneous hot water delivery from a hot water tap.

BACKGROUND OF THE INVENTION

Circulating systems are known in which the cooled down water content of the hot water distribution line is conveyed back into the hot water tank via a recirculation pipe as disclosed in our earlier U.S. Pat. No. 5,143,049. Subsequent retrofit of a recirculation system requires additional piping which may be difficult to install. A different type of hot water recovery system is disclosed in U.S. Pat. No. 5,009,572 Imhoff et al. and U.S. Pat. No. 5,277,219 Lund, in which a recirculation pump is switched on if the hot water temperature near the faucet drops below a pre-determined level or as soon as a hot water faucet is opened. To economize the hot water usage the pump conveys the cooled-down content of the hot water distribution line back through the cold water distribution line into the water heater. Thus the faucets in the distribution line receive warm water when the cooled-down water content between the water heater and the faucets has been pumped into the cold water distribution line.

The aforesaid U.S. Pat. Nos. 5,009,572 Imhoff et al.; 5,143,049 Laing et al.; and 5,277,219 Lund are incorporated into this specification by this reference.

The prior art systems that recirculate the cooled-down portion of the hot water distribution line directly through the cold water distribution line have several drawbacks. The most serious is the fact that the cold water distribution line is first filled with lukewarm, if not hot water. If cold water is needed right after a recirculation cycle, the user must wait several seconds for that heated water to be purged from the cold water distribution line. Another drawback results from the use of various valves in association with the recirculation pump which can cause pressure waves to resound through the plumbing network.

The present invention avoids these drawbacks.

SUMMARY OF THE INVENTION

The primary and secondary objects of the invention are to improve the operation of a hot and cold water system distribution, and to assure an immediate supply of hot water to a hot water faucet by draining any cooled down water in the hot water line into the cold water line for recirculation through the water heater; and to prevent the drawing of lukewarm water that has been purged from the hot water distribution line when the cold water faucet is turned on while, at the same time, avoiding the creation of bothersome pressure waves through the water distribution network when valves controlling the recirculation process are actuated.

In an alternate embodiment of the invention, the volume of cooled down water in the hot water line is flushed back into the water heater by admitting a corresponding volume of cold water out of the cold water line. Immediately thereafter, the cold water is drawn back out of the hot water line and sent into the cold water line, drawing immediately behind it hot water from the water heater.

These and other valuable objects are achieved by means of a pump assembly combined with a cooling radiator installed between the hot water line and the cold water line in the first embodiment. In the second embodiment, a pair of back-to-back pumps provide for the two-way circulation of cold water in and out of the hot water pipe. In both embodiments, the water circulation is controlled by a pressure-sensitive valve installed in the outlet port of each of the pumps which allows circulation therethrough only when, either the pump is activated or, as in the second embodiment, outlet pressure is created by the actuation of the other pump.

DESCRIPTION OF THE PREFERRED EMBODIMENT OF THE INVENTION

Figure 1:
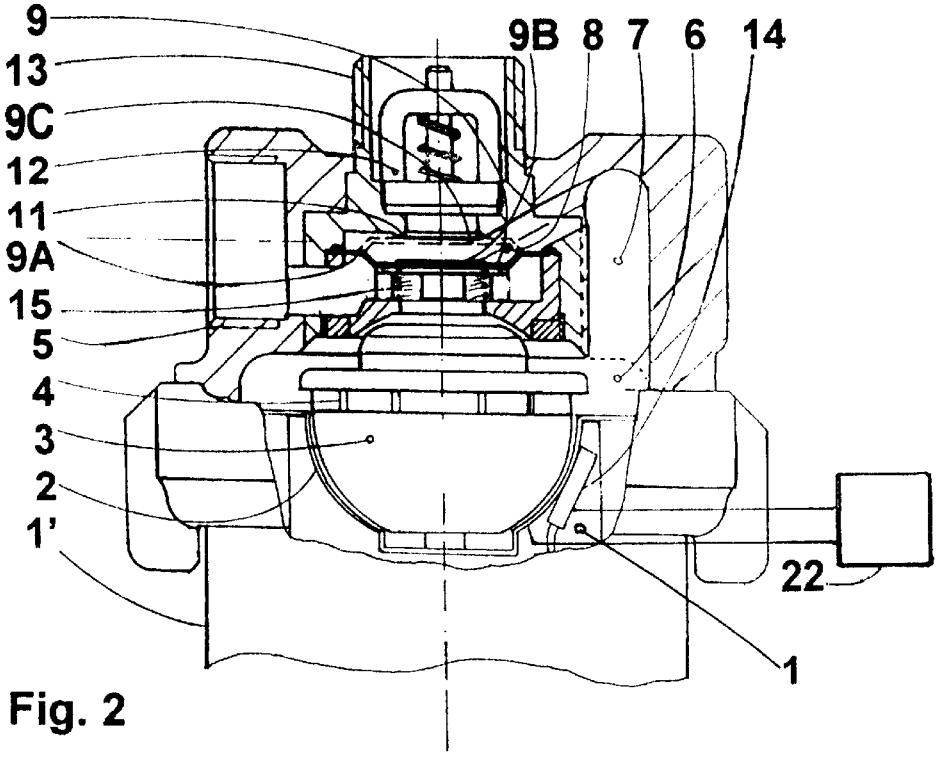
FIG. 1 shows a schematic presentation of the pump-valve-unit.
Figure 5:
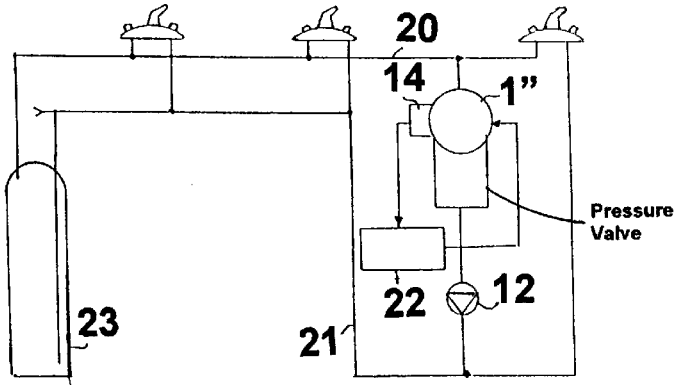
FIG. 5 shows the diagram of a water distribution system.

Referring now to the drawing, there is shown in FIGS. 1 and 5 a circulation pump 1 particularly adapted for use in the instantaneous hot-water delivery system of the invention. Stator 1' creates a rotating magnetic field that acts upon a spherical armature 3 separated from the wet part by a wall 2 driving a pump impeller 4. Inlet port 5 of the pump housing communicates with the hot water distribution line 20. The impeller 4 conveys the cooled-down water from the hot water distribution line 20 into channel 6 of the spiral housing. From there the water runs through the end portion 7 of the spiral channel 6 into an annular region 8 that is closed towards the outlet port 13 by a differential pressure-sensitive valve. That valve is formed by a flexible diaphragm 9, biased toward an annular valve seat 11 by a spring 15. If the pump is switched on, it produces pressure on the rim portion 9A of diaphragm 9, which surrounds the valve seat 11. The diaphragm 9 moves from the dotted line position 9C into the solid line position, thereby translating away from valve seat 11. At the same time the pump pressure opens a check valve 12, so that the cooled-down water content of the hot water distribution line 20 will be conveyed through outlet port 13 of the pump housing into the cold water distribution line 21. A temperature sensor 14 is in good heat conducting contact with the separation wall 2. Its output signals are fed to a two-level thermostat 22 which in turn controls the operation of the pump 1. The thermostat causes the pump 1 to be switched on as soon as the temperature falls below a first predetermined value and to be switched off as soon as a second predetermined higher water temperature has been reached at the end of the hot water distribution line 20. It is advantageous if the temperature sensor 14 causes the pump to be switched off when a predetermined water temperature, lower than the desired water temperature but higher than the first predetermined water temperature is reached, indicating that new hot water has almost reached the end of the hot water distribution line 20, since the very first water arriving at the temperature sensor 14 is always cooler than the following water in the hot water distribution line 20, because it had to heat up the pipe.

It is desirable to provide a thermostat whose dials are easily accessible and that provide to a convenient adjustment of the predetermined higher water temperature or a change of the temperature difference between the higher and lower setting by an unskilled user.

Because each opening of a faucet creates a pressure drop in either line 20 or 21, water from the other distribution line with closed faucets would flow into the pipe with the open faucet in the absence of check valve 12. This valve prevents cold water from entering the hot water distribution line 20. The pressure-sensitive valve with the diaphragm 9 prevents hot water from entering the cold water distribution line 21 as long as the impeller is not running.

Figure 2:
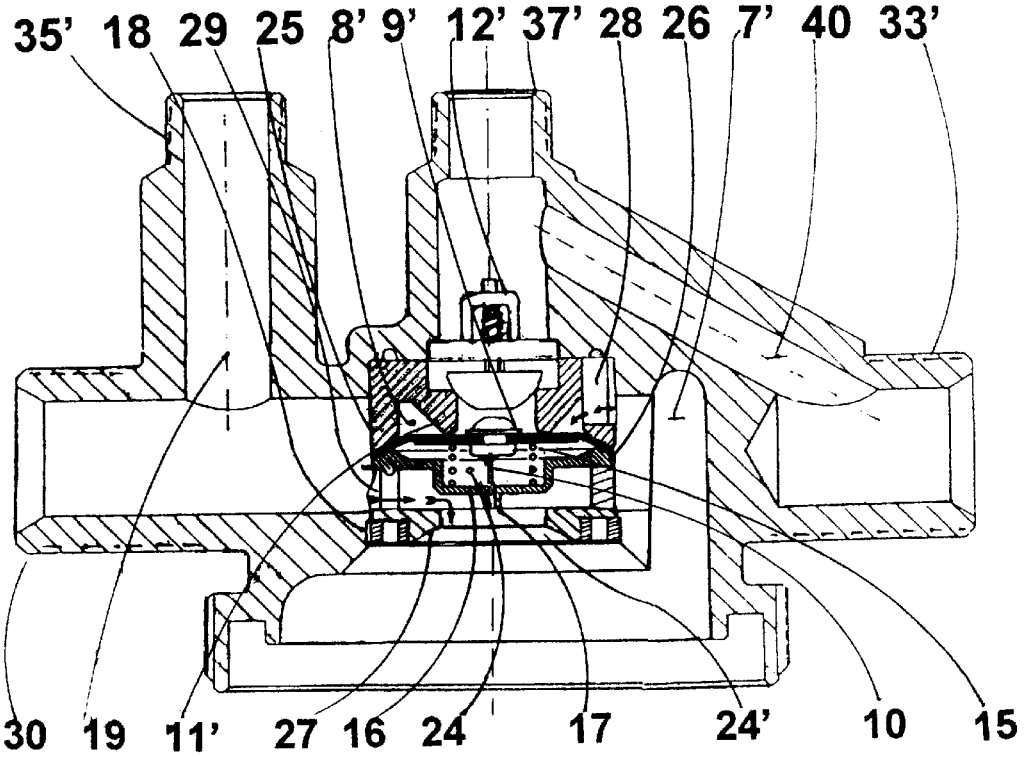
FIG. 2 shows a special pump housing to be inserted between the shutoff valves and the faucets.

As shown in FIG. 2, an alternate embodiment of the pump assembly 23 includes an anti-hammering improvement. A sudden closure of the valve formed by the diaphragm 9' on the valve seat 11' can cause water-hammering noise within the distribution system.

In order to palliate this problem, the movement of the diaphragm 9' is dampened by a close chamber 24 defined by the diaphragm and a rigid septum 16 substantially parallel to, and spaced apart from it in the suction region. The spring 15 is compressed between the diaphragm and the septum. The chamber 24 communicates via a narrow, constricted opening 17 with the suction side 24' of the impeller. This leads to a slow movement or dampening of the diaphragm 9' that prevents the water hammering noise. In order to prevent clogging of the opening 17, a needle 10 projects from the diaphragm 9' into that opening. The diaphragm 9' and other valve elements 25, 26 and 27 are held pressed together by threaded ring 18. Thereby an opening 28 of element 25, points to the end portion 7' of the spiral channel while opening 29 of element 27 points to inlet port 30. Check valve 12' prevents water from the cold water distribution to enter the hot water distribution line 20.

Figure 3:
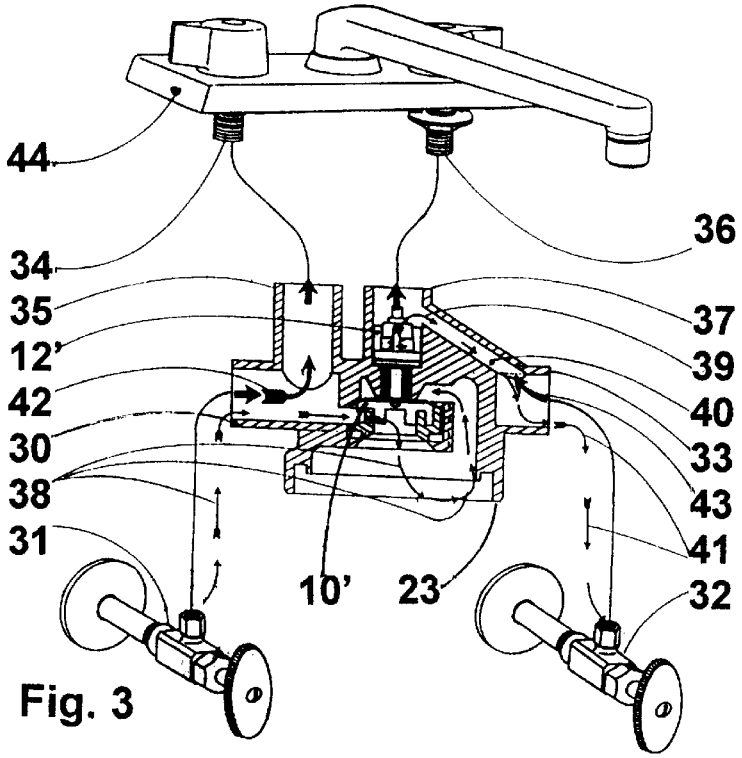
FIG. 3 shows the pump in connection with a set of faucets and shut-off hot and cold water valves.

As illustrated in FIG. 3, the aforesaid pump 23 can be conveniently installed between a hot and cold faucet fixture 44 and the hot and cold water line shut-off valves 31, 32. The inlet port 30 of the pump is connected to the hot water shut-off valve 31, and its outlet port 33 is connected to the cold water shut-off valve 32. A second inlet port 35 of the pump is connected to the hot water faucet 34, and a second outlet port 37 of the pump is connected to the cold water faucet 36.

When the pump 23 is not active, hot water flows to the open hot water faucet 34 from the hot water shut-off valve 31 through the two ports 30, 35 of the pump as indicated by arrow 42. Similarly, cold water flows to the open cold water faucet 36 from the cold water shut-off valve 32 through the two outlet ports 33, 37 of the pump as indicated by arrow 43. When the pump is switched on upon detection of a temperature drop in the hot water reaching the pump inlet port 30, the differential pressure-sensitive valve 10' opens. Lukewarm water is purged from the hot water distribution line through the shut-off valve 31 and the outlet port 33 of the pump toward the cold water shut-off valve 32. First, as indicated by arrow 38, into the spiral housing channel, then through the pressure-sensitive valve 10' and check valve 12' toward the first outlet 33 as indicated by arrows 39, 40 and 41.

Figure 4:
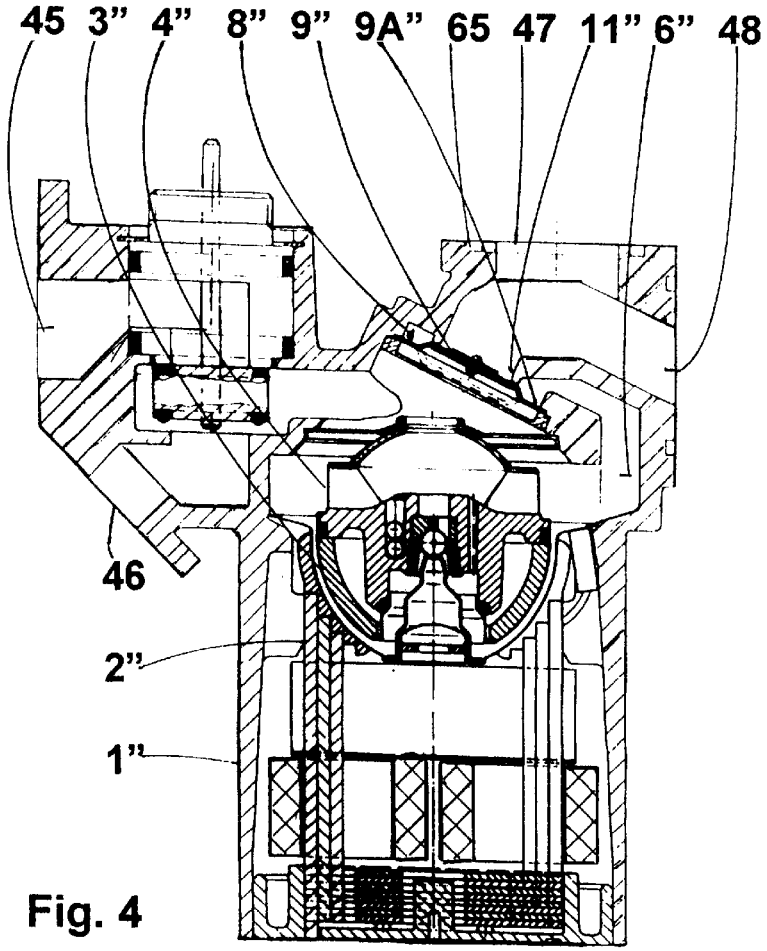
FIG. 4 shows an alternate pump design.

FIG. 4 shows a cross section of a second alternate embodiment of the pump 1" with a housing 65; a stator 2", generating a rotating magnetic field, and an armature 3" driven by said magnetic field which forms a unit with impeller 4". The spiral channel 6" communicates with an annular channel 8" which is covered by the rim portion 9A" of the diaphragm 9". The diaphragm 9" acts as a check valve as long as the pump is shut off. As soon as the impeller 4" rotates, the pressure in spiral channel 6" lifts the diaphragm 9" away from the valve seat 11" so that the water conveyed by the impeller can pass from the inlet port 45 or 46 to the outlet port 47 or 48.

FIG. 5 shows pump 1" installed between the two distribution lines 20 and 21. The hot water distribution line 20 is connected with the outlet port of the hot water tank 23, and the cold water distribution line 21 is connected with the inlet port of said tank 23.

Figures 6, 7:
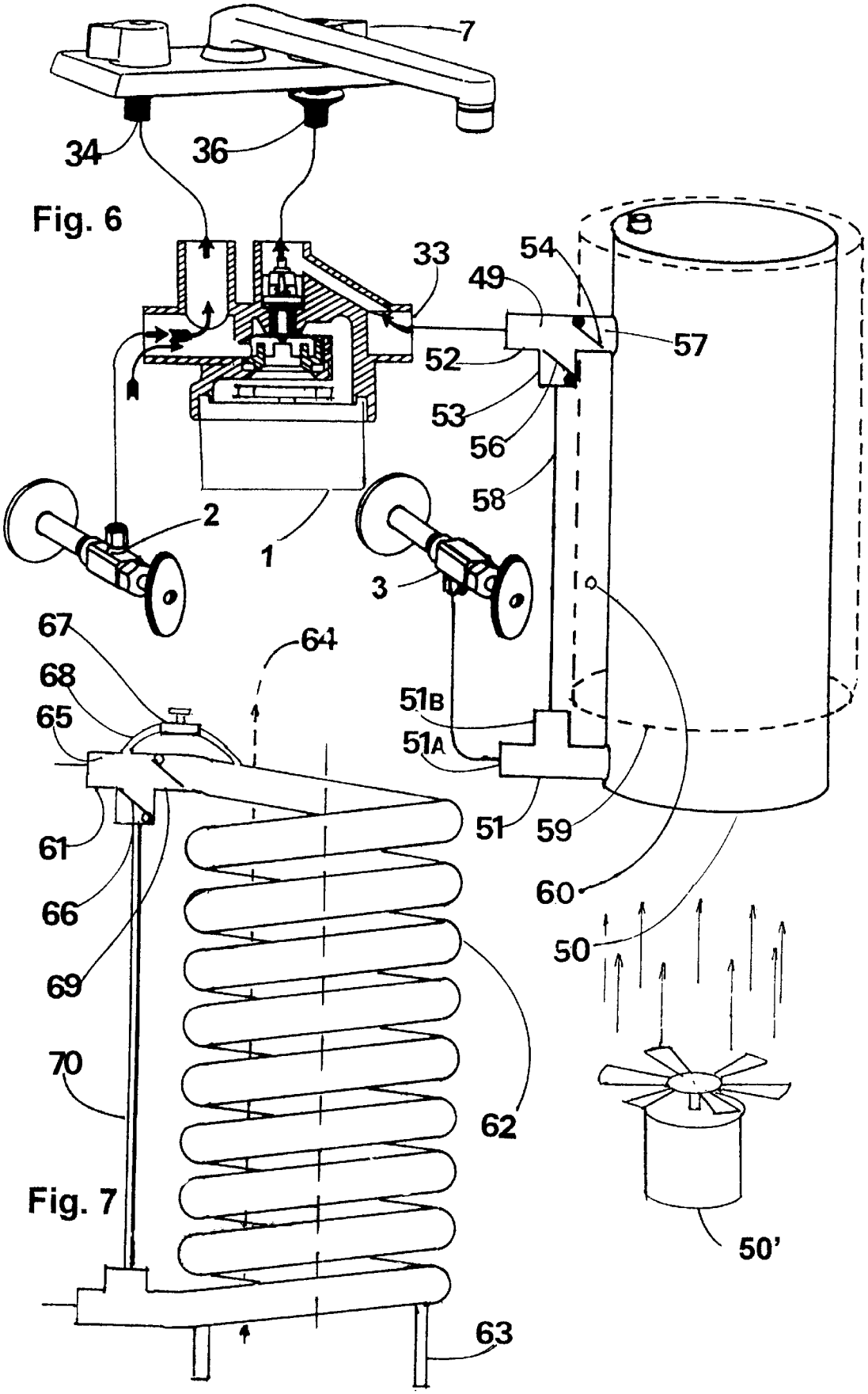
FIG. 6 shows a tank radiator between the cold water port of the pump and the cold water line.
FIG. 7 shows a coil radiator with check valves.

FIG. 6 shows an improved system to prevent delivery of any hot water into the cold water distribution line 21. The water extracted from the hot water line is conveyed through the inlet 52, and a first T-coupling 49 to a cooling vessel 50 having approximately the same volume as the hot water distribution line. At the lower end of the vessel 50 a second T-coupling 51 is attached whose first port 51A is connected to the cold water line 21 and its second port 51B is connected via pipe 58 to a leg 53 of the first T-coupling 49 through a check valve 56 that prevents a direct flow of the water exiting port 33 of the pump into the cold water line 21. A check valve 54 in the outlet 57 of the first T-coupling prevents back flow of water from the vessel 50 to the pump. A hollow cylinder 59 that forms an annular gap 60 with the vessel 50 enhances the thermal air convection. If the cold water faucet 36 is opened, the cold water from cold water distribution line 21 flows through bypass pipe 58. The lukewarm water drawn from the hot water line leaves the pump housing through port 33, and enters the vessel 50 through check valve 54. The cooled down water in the bottom region of vessel 50 will be conveyed into the cold water distribution line 21. If the water content of the hot water line 20 exceeds the volume of the vessel, two vessels can be connected in series. To enhance the convection, the vessel is positioned within the air stream of an electrically driven cooling fan 50'.

FIG. 7 shows an alternative configuration. Instead of a vessel a radiator coil 62 is used which has the advantage that a mixture between warm water and cooler water will be impossible. Coil 62 sits on supports 63, which allows air 64 to pass through the inner space of the coil whereby the larger contact surface increases the heat dissipation. In the case where the hot and cold water taps are so far away from the water heater that the amount of cooled-down water exceeds the capacity of the coil, increase in the temperature of the cold water drawn through the cold water faucet can be compensated by a partial mixing of the cold and lukewarm water. To that effect, another T-coupling 61 is connected to the leg 65 of the upper T-coupling 69. A pipe 68 runs from there to the inside of the vessel 50 or the coil 62. Due to the pressure drop caused by the check valve 66 water from the inside of the coil or vessel will flow through pipe 68 to be admixed to the flow of cold water coming up through bypass pipe 70. The mixing ratio can be controlled by valve 67.

Figure 8:
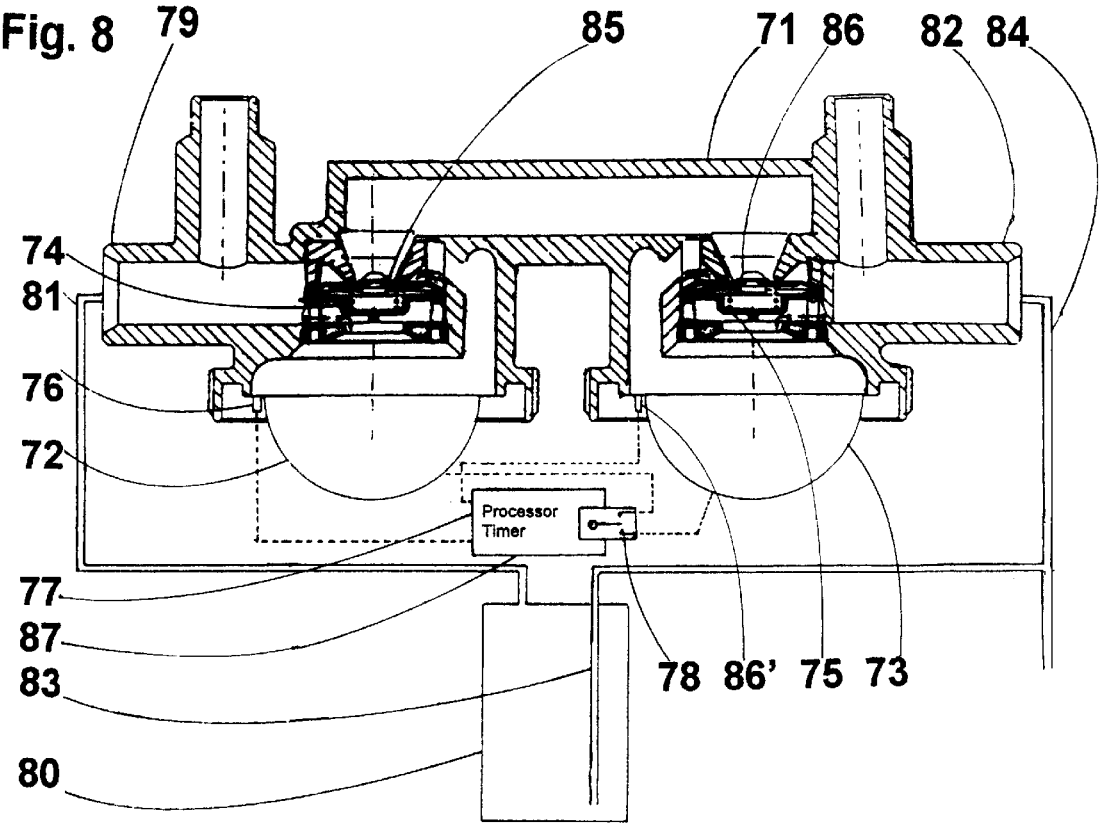
FIG. 8 shows a dual-pump hot water recirculation assembly.

FIG. 8 illustrates an alternate embodiment of the hot water recirculation system which does not rely on the use of a cooling radiator vessel, but recirculates the cooled-down water back to the water heater through the hot water distribution line.

The system uses dual pump assembly 71 comprising a second pump 73 connected outlet-to-outlet with the first pump 72. The pumps resemble the pump in FIG. 2, all pumps are shown without motors. In contrast to the pump shown in FIG. 2, these two pumps do not have the second check valve 12', but the same type of differential pressure valves. The first pump 72 has a temperature-sensor 76 and processor 77 with a change over switch 78. The inlet port 79 of the first pump is connected to the hot water tank 80 via the hot water distribution line 81. The inlet port 82 of second pump 73 communicates with the immersion tube 83 of the hot water tank 80 via the cold water distribution line 84. As soon as the temperature sensor 76 signals to the processor 77 that the water temperature has fallen below a predetermined level, the processor 77 starts running and actuates the second pump 73. This pump conveys cold water from the cold water distribution line 84 through both pumps into the hot water distribution line 81.

This is due to the fact that the pressure-sensitive valves 74, 75 are opened in both pumps, valve 74 under the push of the admitted cold water and valve 75 under the pressure of the second pump 73. From the lower, cooler part of the hot water tank 80, an equal amount of water flows through the immersion tube 83 and through the cold water distribution line 84 into the second pump 73, in contact with the temperature sensor 86/. The temperature of this water is higher than the temperature of the initial flow of cold water. Upon detection of that temperature increase, the switch 78 is flipped so that now the first pump 72 is switched on and the second pump 73 is switched off. That first pump 72 conveys the cold water content of the hot water distribution line 81 into the cold water distribution line 84, pushing the content of the cold water distribution line back into the hot water tank. Hereby, the same amount of hot water is sucked from the hot water tank through the hot water distribution line to the housing of the first pump 72. As soon as the hot water reaches the temperature-sensor 76, the first pump 72 goes off. Now the hot water distribution line is filled with hot water while the cold water distribution line is filled with cold water.

The membrane valve 85 of the first pump 72 opens under pressure of the cold water conveyed by the second pump 73, so that cold water can pass through both pumps. Similarly, as soon as the first pump 72 is switched on, the membrane valve of the second pump 73 opens and lets the water conveyed by first pump 72 pass. However, when both pumps are switched off, valve 85 of the first pump prevents hot water in the hot water distribution line from passing into the cold water distribution line. The membrane valve 86 of the second pump 73 prevents flow of cold water in the opposite direction.

It is also possible to use a timer 87 to switch to pump 72, whereby the change from the second pump 73 to the first pump 72 is triggered when the cooled-down water in the hot water distribution line 81 has reached the hot water tank 80.

While the preferred embodiments of the invention have been described, modifications can be made and other embodiments may be devised without departing from the spirit of the invention and the scope of the appended claims.

What is claimed is:

1. In a hot and cold water distribution system wherein hot water is distally delivered through a hot water line from a water heater to a hot water faucet, and cold water is delivered through a cold water line to said water heater and to a cold water faucet proximate to said hot water faucet, and a hot water recirculation pump assembly is provided proximate said faucets to draw cooled-down water out of said hot water line and back into said water heater, an improvement which comprises:

means for preventing said cooled-down water from being drawn through said cold water faucet;

said means for preventing including a cooling vessel connected in series between said pump assembly and said cold water line;

wherein said pump assembly comprises at least one pump; and a cooling fan positioned to act upon said vessel.

2. The improvement of claim 1 wherein said vessel comprises a radiator coil.

3. In a hot and cold water distribution system wherein hot water is distally delivered through a hot water line from a water heater to a hot water faucet, and cold water is delivered through a cold water line to said water heater and to a cold water faucet proximate to said hot water faucet, and a hot water recirculation pump assembly is provided proximate said faucets to draw cooled-down water out of said hot water line and back into said water heater, said recirculation pump having an outlet, an improvement which comprises:

means for preventing said cooled-down water from being drawn through said cold water faucet;

said means for preventing including a cooling vessel connected in series between said pump assembly and said cold water line;

said cooling vessel being connected to temporarily hold said cooled-down water;

wherein said pump assembly comprises at least one pump; and wherein said vessel includes a input port connected to said outlet and a output port connected to the cold water line; and which further comprises:

a first bypass line between the cold water line and said input port;

a first check-valve in said bypass line biased and positioned to prevent water from flowing from said outlet to said cold water line; and a second check-valve between said outlet and said input port biased and positioned to prevent water from flowing out of said vessel toward said outlet.

4. The improvement of claim 3, which further comprises a flow-adjustable line connected between said outlet and said vessel.

5. In a hot and cold water distribution system wherein hot water is distally delivered through a hot water line from a water heater to a hot water faucet, and cold water is delivered through a cold water line to said water heater and to a cold water faucet proximate to said hot water faucet, and a hot water recirculation pump assembly is provided proximate said faucets to draw cooled-down water out of said hot water line and back into said water heater, an improvement which comprises:

means for preventing said cooled-down water from being drawn through said cold water faucet;

wherein said means for preventing comprises:

means for temporarily replacing said lukewarm water with a volume of cold water within said hot water line; and means for drawing said volume of cold water out of said hot water line and into said cold water line, whereby said lukewarm water is forced back into said water heater prior to drawing said volume of cold water from said hot water line:

wherein said pump assembly comprises:

a pair of pumps, each having an inlet and an outlet;

the outlets of said pumps being connected together;

the inlet of a first pump being connected to the hot water line;

the inlet of a second pump being connected to the cold water line;

means for detecting a drop of water temperature in said water line;

means responsive to said means for detecting for activating said second pump for a period sufficient to fill said hot water line through said first pump with a volume of cold water; and for subsequently activating said first pump to draw said volume of water out of the hot water line and force it into said cold water line through said second pump.

6. The improvement of claim 5, wherein each of said pump comprises:

an impeller;

a suction region ahead of said impeller;

a pressure region behind said impeller;

a inlet leading to said suction region;

a outlet leading to said pressure region;

a pressure-driven valve between said pressure region and said outlet; and means for closing said pressure-driven valve in the absence of water pressure in said pressure region.

7. The improvement of claim 6, wherein said means for closing comprise:

a valve seat associated with said outlet;

a diaphragm between said suction region and said pressure region;

said diaphragm being translatable between a first position toward said pressure region and a second position toward said suction region; and resilient means for biasing said diaphragm toward said pressure region.

8. The improvement of claim 7, wherein said resilient means for biasing holds said diaphragm toward said first position wherein a part of said diaphragm contacts said valve seat when the pump is not activated; whereby activation of the pump causes the diaphragm to translate toward said second position away from said valve seat under water pressure in said pressure region.

9. The improvement of claim 8, wherein said resilient means for biasing comprises:

a rigid and fixed septum substantially parallel to, and spaced apart from said diaphragm in the suction region;

said septum and diaphragm defining a closed chamber;

a spring compressed between said diaphragm and said septum; and said chamber having a constricted opening through said septum to said suction region;

whereby the movement of the diaphragm is dampened by the flow of water in and out of said chamber through said constricted opening.

10. The improvement of claim 9 which further comprises a needle extending from said diaphragm into said constricted opening.

11. The improvement of claim 5, wherein said means for activating said first pump comprises a timer for controlling an activation time for said first pump.

12. A pump for circulating fluid between an inlet and an outlet which comprises:

a suction region in communication with said inlet;

a pressure-sensitive check-valve associated with said outlet and pressure region, said check-valve including:

a valve seat associated with said outlet, a diaphragm between said suction region and said pressure region;

said diaphragm being translatable between a first position toward said pressure region and a second position toward said suction region; and resilient means for biasing said diaphragm toward said pressure region;

wherein said resilient means for biasing holds said diaphragm toward said first position and a part of said diaphragm contacts said valve seat when the pump is not activated; whereby activation of the pump causes the diaphragm to translate toward said second position away from said valve seat under water pressure in said pressure region;

wherein said resilient means for biasing comprises:

a rigid and fixed septum substantially parallel to, and spaced apart from said diaphragm in the suction region;

said septum and diaphragm defining a closed chamber;

resilient means for biasing said diaphragm toward said valve seat;

said chamber having a constricted opening through said septum to said suction region;

whereby the movement of the diaphragm is dampened by the flow of water in and out of said chamber through said constricted opening.

13. The improvement of claim 12 which further comprises a needle extending from said diaphragm into said constricted opening.

* * * * *